US006639348B1

(12) United States Patent
Ito et al.

(10) Patent No.: US 6,639,348 B1
(45) Date of Patent: Oct. 28, 2003

(54) CRT HAVING AN IMPROVED INTERNAL CONDUCTIVE COATING AND MAKING THE SAME

(75) Inventors: Hiroshi Ito, Mobara (JP); Shunichi Matsumoto, Chiba (JP); Kiyoshi Sento, Sakura (JP); Kazuyuki Nishimura, Chiba (JP); Nobuhiko Hosotani, Mobara (JP); Masatoshi Akiyama, Yotsukaido (JP)

(73) Assignees: Hitachi, Ltd, Tokyo (JP); Hitachi Device Engineering Co., Ltd., Mobara (JP)

( * ) Notice: Subject to any disclaimer, the term of this patent is extended or adjusted under 35 U.S.C. 154(b) by 0 days.

(21) Appl. No.: 09/531,453

(22) Filed: Mar. 20, 2000

(30) Foreign Application Priority Data

Mar. 19, 1999 (JP) ..... 11-074883

(51) Int. Cl.[7] ..... H01J 31/00

(52) U.S. Cl. ..... 313/479; 313/477 R; 313/477 HC; 313/450; 445/45; 445/14; 427/58; 427/64; 106/470; 106/475

(58) Field of Search ..... 313/477 R, 477 HC, 313/479, 450; 445/14, 45; 427/58, 64; 106/475, 470

(56) References Cited

U.S. PATENT DOCUMENTS

| | | | | |
|---|---|---|---|---|
| 4,052,641 A | * | 10/1977 | Dominick et al. | 313/479 |
| 4,272,701 A | * | 6/1981 | Gallaro et al. | 313/479 |
| 4,379,762 A | * | 4/1983 | Chiyoda et al. | 313/479 |
| 4,403,170 A | | 9/1983 | Misono et al. | 313/479 |
| 4,602,187 A | * | 7/1986 | Fischman et al. | 313/479 |
| 4,760,310 A | * | 7/1988 | Deyama et al. | 313/479 |
| 5,160,375 A | * | 11/1992 | Otaki | 313/479 |
| 5,998,920 A | * | 12/1999 | Kim | 313/479 |

OTHER PUBLICATIONS

Japanese Patent Application Laid–open No. Sho 59–171439 (Japan Patent Publication No. Hei 4–43374) and English Language Abstract.

Japanese Patent Application Laid–open No. Sho 55–150539 (Japan Patent Publication No. Sho 64–5741) and English Language Abstract.

* cited by examiner

*Primary Examiner*—Ashok Patel
*Assistant Examiner*—Mariceli Santiago
(74) *Attorney, Agent, or Firm*—Antonelli, Terry, Stout & Kraus, LLP

(57) ABSTRACT

A color cathode ray tube includes an evacuated envelope having a generally rectangular panel portion, a narrow neck portion having a circular cross-section and a funnel portion tapering down from a panel-portion side thereof toward a neck-portion side thereof for connecting the panel portion and the neck portion, a three-color phosphor screen formed on an inner surface of the panel portion, an electron gun housed in the neck portion, and an internal conductive film extending from an inner wall of the neck portion to an inner wall of the funnel portion. The funnel portion is provided with a yoke-mounting portion of generally truncated quadrilateral-pyramidal shape for mounting a beam deflection yoke therearound on the neck-portion side of the funnel portion. The internal conductive film is formed of a first part and a second part, the first part is formed of graphite, metallic oxide and potassium silicate, and the second part is formed of graphite and potassium silicate. The first part extends from the neck portion in the vicinity of a forward end of the electron gun to a position in the yoke-mounting portion spaced a distance in a range of 60 mm to 150 mm from a splice line between the neck portion and the funnel portion, and the second part overlaps with the first part at opposing ends thereof and extends to a vicinity of a seal line between the funnel portion and the panel portion.

6 Claims, 6 Drawing Sheets

CRT HAVING AN IMPROVED INTERNAL CONDUCTIVE COATING AND MAKING THE SAME

BACKGROUND OF THE INVENTION

The present invention relates to a cathode ray tube, and in particular to a cathode ray tube having a portion of a funnel portion for mounting a deflection yoke formed in generally truncated quadrilateral-pyramidal shape for the purpose of power saving and having a uniformity in thickness of an internal conductive coating improved in the portion of generally truncated quadrilateral-pyramidal shape to improve reliability of the cathode ray tube.

Generally, a cathode ray tube for displaying images or the like is provided with an evacuated envelope comprising a panel portion having a viewing screen formed of phosphor elements coated on an inner surface thereof, a neck portion for housing an electron gun and a funnel portion tapering down from a diameter of the panel portion to a diameter of the neck portion for connecting the panel portion and the neck portion.

In a color cathode ray tube for displaying color images, a color viewing screen is formed by coating phosphor elements of a plurality (usually three) of colors on the inner surface of the panel portion, a shadow mask serving as a color selection electrode is closely spaced from the screen and suspended within the panel portion, and an in-line type electron gun for emitting three electron beams is housed in the neck portion.

A stem provided at an end of the neck portion closes the end of the neck portion, supports the electron gun and supplies required voltages and a signal to the electron gun via respective stem pins embedded through the stem and arranged in a circular array, and a deflection yoke is mounted around the outside of the funnel portion for deflecting the electron beams two-dimensionally in the horizontal and vertical directions to reproduce an image on the screen.

Color cathode ray tubes for use in a high definition TV receiver or a monitor set for an information-processing terminal often employ higher voltages and a higher deflection frequency than before, and consequently increase deflection power consumption.

In such cathode ray tubes, as means for reducing power consumption of the deflection yoke, it is effective to reduce an outside diameter of a portion of the funnel portion around which the deflection yoke is mounted such that deflection magnetic fields act on the electron beams efficiently.

A portion of a funnel portion around which a deflection yoke is mounted will be hereinafter referred to merely as a yoke-mounting portion in this specification.

But, if an outside diameter of the yoke-mounting portion is reduced, some portions of the phosphor screen in the panel portion are sometimes not scanned by the electron beam because an inside diameter of the funnel portion in the vicinity of a junction of the funnel portion and the neck portion (that is, the smaller end of the funnel portion) becomes too small and the electron beam strikes the inner wall of the funnel portion when the electron beam is at maximum deflection.

In consideration of such facts, Japanese Patent Application Laid-open No. Hei 10-144238 (laid-open on May 29, 1998) discloses a cathode ray tube provided with a yoke-mounting portion of the funnel portion having an outer wall in the truncated quadrilateral-pyramidal shape so as to bring the deflection yoke in close proximity to electron beam and prevent occurrence of portions of the phosphor screen not scanned by the electron beam.

But, if the outer wall of the yoke-mounting portion of the funnel portion is formed in the truncated quadrilateral-pyramidal shape, the mechanical strength of the evacuated envelope is weakened and likelihood of implosion of the evacuated envelope becomes stronger. In Japanese Patent Application Laid-open No. Hei 10-144238, a reinforcing member is employed in a junction region of the panel portion and the yoke-mounting region of the truncated quadrilateral-pyramidal shape to prevent the implosion of the evacuated envelope. In a cathode ray tube disclosed therein, a cross-section of the outer wall of the yoke-mounting region perpendicular to its tube axis is a rectangle, and a cross-section of its inner wall is also a rectangle approximately similar to that of the outer wall of the yoke-mounting region.

For the purpose of eliminating the interception of an electron beam at the junction region (the smaller end of the funnel portion)of the funnel portion and the panel portion and preventing implosion of the evacuated envelope even when the maximum deflection of electron beam is increased, Japanese Utility Model Publication No. Sho 44-29152 (published on December 3) discloses a cathode ray tube in which a cross-section perpendicular to the tube axis, of an inner wall of the smaller end of the funnel portion is such that four sides or two parallel sides of the cross-section are curved convexly toward the tube axis at required regions thereof (that is, pincushion-shaped) and the corners of the cross-section are rounded.

In cathode ray tubes, the nearly entire area of the inner wall of the funnel portion and the inner wall of an area of the neck portion contiguous with the funnel portion are coated with an internal graphite film serving as an internal conductive coating.

For example, Japanese Patent Publication Nos. Sho 64-5741 (published on Jan. 31, 1989) and Hei 4-43374 (published on Jul. 16, 1992) and U.S. Pat. No. 4,403,170 (issued on Sep. 6, 1983) disclose techniques for dividing an internal graphite film in plural sections.

The internal graphite film forms a high-voltage filter capacitor with an external graphite film coated on the outer wall of the funnel portion, and conveys a high voltage applied to an anode button extending through a wall of a large-diameter portion of the funnel portion, to an anode electrode of an electron gun.

The internal graphite film is formed by coating a solution containing graphite particles, metallic oxides such as titanium oxide and iron oxide, water glass and others dispersed in a solvent on the inner wall of the funnel portion before the funnel portion is joined to the panel portion, and then drying.

Generally, the internal graphite film is coated by an automatic brushing machine in which the funnel portion is vertically oriented with its large-diameter end to be joined to the panel portion facing upward and its neck-portion side facing downward, and is rotated. As other techniques for coating, spraying and flow-coating are known.

SUMMARY OF THE INVENTION

In the above-mentioned cathode ray tube having a yoke-mounting portion formed in generally truncated quadrilateral-pyramidal shape, in the large-diameter region of the inner wall of the funnel portion there is no problem with coating of the internal graphite film because the inner wall in the large-diameter region of the funnel portion is nearly flat and consequently, non-uniformity in coating or formation of pools of coating material at corners of the quadrilateral-pyramidal shape does not occurs, but the yoke-mounting portion is prone to non-uniformity in coating of the graphite solution, formation of pools of the graphite solution at corners of the quadrilateral-pyramidal shape, or flowing down of the graphite solution into the neck portion, because the cross-sectional area of the inner wall is small in the yoke-mounting portion.

Specially, in the cathode ray tube in which the cross-section of the inner wall of the yoke-mounting portion is such that four sides or two parallel sides of the cross-section are curved convexly toward the tube axis at required regions thereof to form the shape of a pincushion, as disclosed in Japanese Utility Model Publication No. Sho 44-29152, a brush cannot contact the inner wall of the yoke-mounting portion closely, and consequently, non-uniformity in coating of the graphite solution, or formation of pools of the coating solution at corners of the quadrilateral-pyramidal shape occurs.

The objects of the above-mentioned first prior art related to the shape of the evacuated envelope are to eliminate occurrence of an area of the phosphor screen which is not scanned by an electron beam in a cathode ray tube of a wide deflection angle and to increase the mechanical strength of the evacuated envelope. The objects of the remaining prior art related to the internal graphite film are to eliminate an electrical discontinuity between the graphite film and an electrode and to reduce a spark current within the tube. None of the above prior art disclose or imply a problem with coating operation of the internal graphite film.

It is an object of the present invention to provide a cathode ray tube which facilitates and assures coating of the internal graphite on the inner wall of the yoke-mounting portion of its funnel portion.

To accomplish the above object, in accordance with an embodiment of the present invention, there is provided a cathode ray tube comprising: an evacuated envelope comprising a generally rectangular panel portion, a narrow neck portion having a circular cross-section and a funnel portion tapering down from a panel-portion side thereof toward a neck-portion side thereof for connecting said panel portion and said neck portion, said funnel portion being provided with a yoke-mounting portion of generally truncated quadrilateral-pyramidal shape for mounting a beam deflection yoke therearound on said neck-portion side of said funnel portion; a three-color phosphor screen formed on an inner surface of said panel portion; an electron gun housed in said neck portion; and an internal conductive film extending from an inner wall of said neck portion to an inner wall of said funnel portion, said internal conductive film comprising a first part and a second part, said first part being formed of graphite, metallic oxide and potassium silicate, said second part being formed of graphite and potassium silicate, wherein said first part extends from said neck portion in the vicinity of a forward end of said electron gun to a position in said yoke-mounting portion spaced a distance in a range of 60 mm to 150 mm from a splice line between said neck portion and said funnel portion, and said second part overlaps with said first part at opposing ends thereof and extends to a vicinity of a seal line between said funnel portion and said panel portion.

To accomplish the above object, in accordance with another embodiment of the present invention, there is provided a method of manufacturing a color cathode ray tube comprising an evacuated envelope comprising a generally rectangular panel portion, a narrow neck portion having a circular cross-section and a funnel portion tapering down from a panel-portion side thereof toward a neck-portion side thereof for connecting said panel portion and said neck portion, said funnel portion being provided with a yoke-mounting portion of generally truncated quadrilateral-pyramidal shape for mounting a beam deflection yoke therearound on said neck-portion side of said funnel portion, a three-color phosphor screen formed on an inner surface of said panel portion, an electron gun housed in said neck portion, and an internal conductive film extending from an inner wall of said neck portion to an inner wall of said funnel portion, comprising the steps of: forming a first part of said internal conductive film composed of graphite, metallic oxide and potassium silicate in an area extending from said neck portion in the vicinity of a forward end of said electron gun to a position in said yoke-mounting portion spaced a distance in a range of 60 mm to 150 mm from a splice line between said neck portion and said funnel portion, and forming a second part of said internal conductive film composed of graphite and potassium silicate in an area overlapping with an end of said first part on a panel-portion side thereof and extending to a vicinity of a seal line between said funnel portion and said panel portion.

To accomplish the above object, in accordance with still another embodiment of the present invention, there is provided a method of manufacturing a color cathode ray tube comprising an evacuated envelope comprising a generally rectangular panel portion, a narrow neck portion having a circular cross-section and a funnel portion tapering down from a panel-portion side thereof toward a neck-portion side thereof for connecting said panel portion and said neck portion, said funnel portion being provided with a yoke-mounting portion of generally truncated quadrilateral-pyramidal shape for mounting a beam deflection yoke therearound on said neck-portion side of said funnel portion, a three-color phosphor screen formed on an inner surface of said panel portion, an electron gun housed in said neck portion, and an internal conductive film extending from an inner wall of said neck portion to an inner wall of said funnel portion, comprising the steps of: forming an upstream subpart of a first part of said internal conductive film composed principally of 15 to 25 weight % graphite, 15 to 25 weight % titanium oxide and 45 to 70 weight % potassium silicate in an area extending from said neck portion in the vicinity of a forward end of said electron gun to a first position in the vicinity of a splice line between said neck portion and said funnel portion; forming a downstream subpart of said first part of said internal conductive film composed principally of 15 to 25 weight % graphite, 45 to 70 weight % titanium oxide and 35 to 60 weight % potassium silicate in an area contiguous to a forward boundary of said upstream subpart and extending to a second position in said yoke-mounting portion spaced a distance in a range of 60 mm to 150 mm from said splice line; and forming a second part of said internal conductive film composed principally of 60 to 70 weight % graphite and 35 to 45 weight % potassium silicate in an area overlapping with an end of said downstream subpart of said first part on a panel-portion side thereof and extending to a vicinity of a seal line between said funnel portion and said panel portion.

With the configuration of the present invention, a highly reliable cathode ray tube with its deflection power consumption reduced and a method of making the same are obtained wherein the operation of coating of the internal graphite film on the yoke-mounting portion is facilitated such that non-uniformity in thickness caused by non-uniform coating of the graphite solution and by formation of pools of the graphite solution at corners of the quadrilateral-pyramidal shape, or flowing down of the graphite solution into the neck portion is prevented.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The present invention will now be explained in detail with reference to the accompanying drawings.

Figure 1:
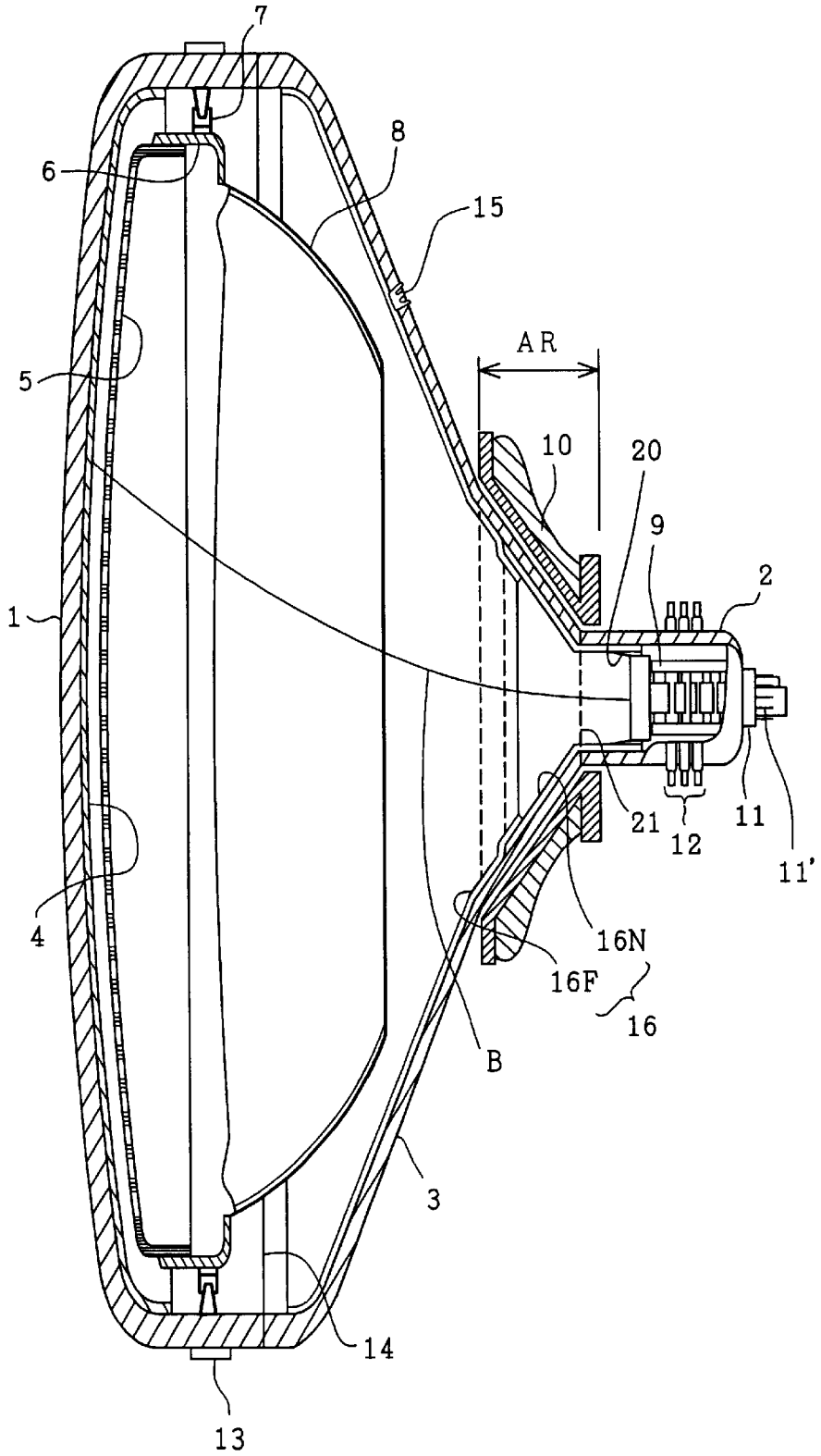
FIG. 1 is a longitudinal cross-sectional view of a color cathode ray tube in accordance with an embodiment of the present invention for explaining its overall structure.

FIG. 1 is a longitudinal cross-sectional view of a color cathode ray tube in accordance with an embodiment of the present invention for explaining its overall structure. In this color cathode ray tube, its evacuated envelope is comprised of a panel portion 1 having a viewing screen formed of phosphor elements 4 coated on the inner surface of the panel portion 1, a neck portion housing an electron gun 9 and a funnel portion 3 connecting the panel portion 1 and the neck portion 2.

A shadow mask 5 is closely spaced from the phosphor elements 4 of the panel portion 1. The shadow mask 5 is welded to a mask frame 6 which, in turn, is suspended via a suspending mechanism 7 affixed to an inner wall of a skirt of the panel portion 1.

A magnetic shield 8 is fixed to the mask frame 6 for shielding the electron beams B (only one of which is shown) from external magnetic fields such as the earth's magnetic field.

As shown in FIG. 1, a yoke-mounting portion AR around which a deflection yoke 10 is mounted is situated in the vicinity of a transition region of the funnel portion 3 and the neck portion 2, and has inner and outer walls of the shapes described subsequently in connection with FIGS. 2 to 4.

A stem 11 having stem pins 11' extending therethrough for supplying required voltages and a signal to the electron gun 9 is sealed to an end of the neck portion 2. An external magnetic device 12 is mounted around the outside of the neck portion 2 for adjusting color purity and static convergence of the electron beams. Reference numeral 13 denotes an implosion protection band,reference numeral 14 denotes a seal line between the panel portion 1 and the funnel portion 3 and reference numeral 21 denotes a splice line between the neck portion 2 and the funnel portion 3.

Reference numeral 15 denotes an anode button extending through the funnel portion 3, and the anode button 15 is electrically connected to an internal conductive film 16 extending from the inner wall of the funnel portion 3 to the inner wall of the neck portion 2. A plurality of bulb spacers 20 (one of which is shown) center the electron gun 9 within the neck portion 2 and electrically connect the forward portion of the electron gun 9 with the internal conductive film 16.

The internal conductive film 16 comprises a first part 16N of the internal conductive film 16 extending from the inner wall of the neck portion 2 into the inner wall of the yoke-mounting portion AR and a second part 16F of the internal conductive film 16 overlapping an adjacent end of the first part 16N, extending to the vicinity of the seal line 14 and covering the approximately entire area of the inner wall of the funnel portion 3.

Figure 2:
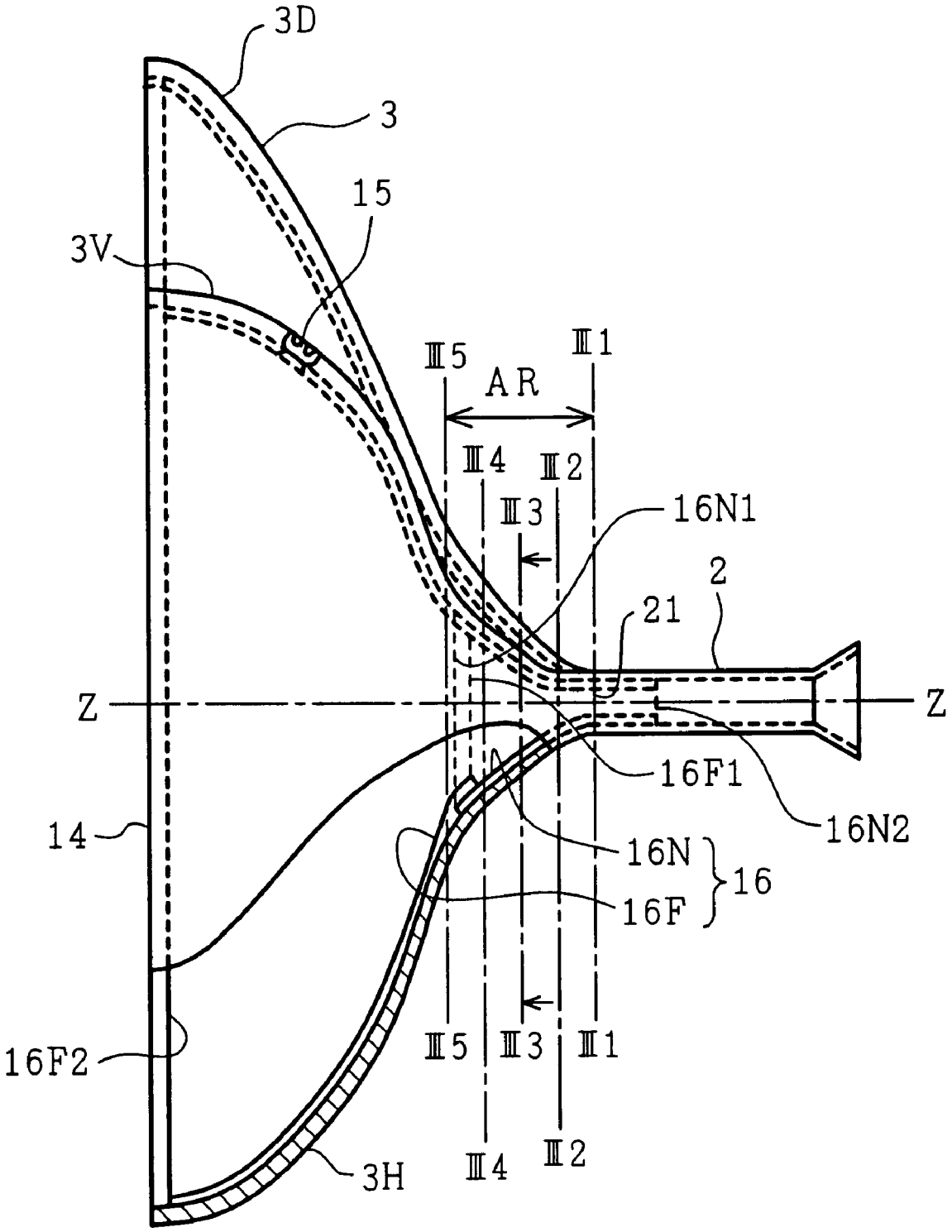
FIG. 2 is a schematic composite diagram of the major axis, minor axis and diagonal partially broken-away side views of the funnel portion of the color cathode ray tube of FIG. 1.

FIG. 2 is a schematic composite diagram of the major axis, minor axis and diagonal partially broken-away side views of the funnel portion of the color cathode ray tube of FIG. 1.

In FIG. 2, reference numeral 2 denotes the neck portion before one end of the neck portion 2 is sealed by the stem 11, 3V, 3H and 3D are minor axis, major axis and diagonal side views of the funnel portion 2, respectively, 15 is the anode button, 16 is the internal conductive film, Z—Z is a tube axis, and AR is the yoke-mounting portion.

The internal conductive film 16 comprises the first part 16N extending from the inner wall of the neck portion 2 into the inner wall of the yoke-mounting portion AR and the second part 16F disposed in the inner wall of the funnel portion 3. The second part 16F of the internal conductive film 16 is electrically connected to the anode button 15.

Figure 3A:
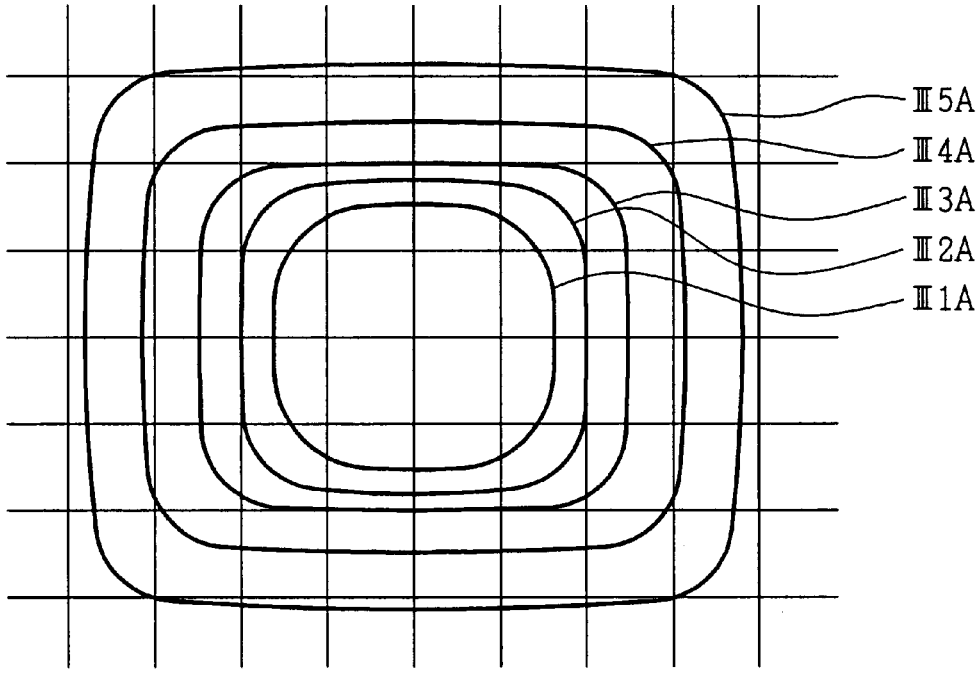
FIG. 3A is a compound view showing cross-sections of outer wall contours of the yoke-mounting portion taken at lines of III1—III1, III2—III2, III3—III3, III4—III4 and III5—III5 of FIG. 2.
Figure 3B:
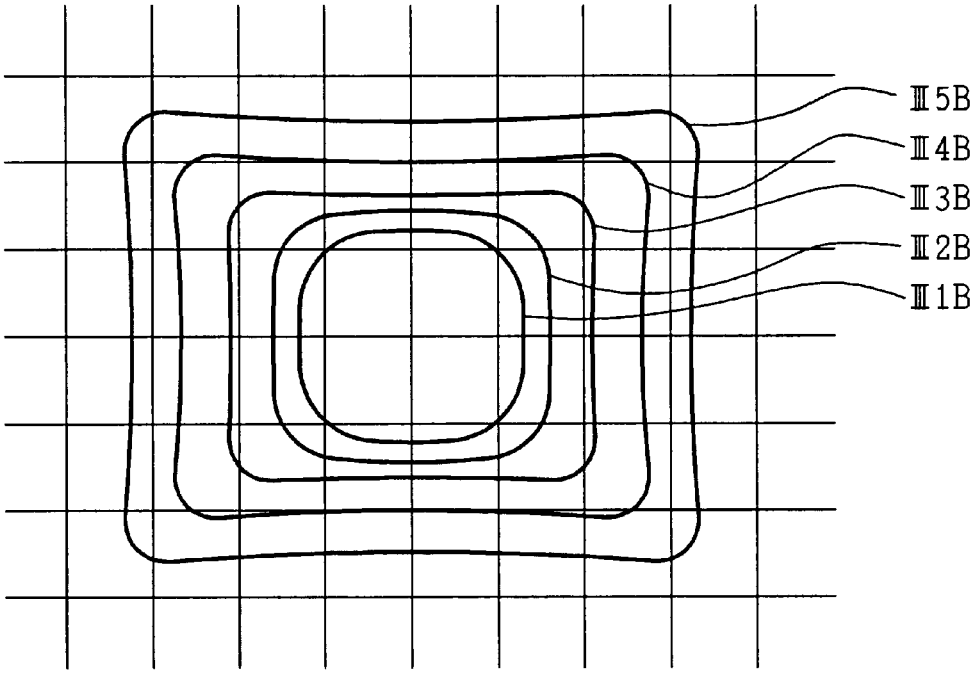
FIG. 3B is a compound view showing cross-sections of inner wall contours of the yoke-mounting portion taken at lines of III1—III1, III2—III2, III3—III3, III4—III4 and III5—III5 of FIG. 2.

FIG. 3A is a compound view showing cross-sections of outer wall contours of the yoke-mounting portion AR taken at lines III1—III1, III2—III2, III3—III3, III4—III4 and III5—III5 of FIG. 2, and FIG. 3B is a compound view showing cross-sections of inner wall contours of the yoke-mounting portion AR taken at lines III1-III1, III2—III2, III3—III3, III4—III4 and III5—III5 of FIG. 2. In FIGS. 3A and 3B, grid patterns are added for clarifying the curvatures of the outer and inner wall contours. The section line III1—III1 is positioned in the vicinity of the splice line 21 between the neck portion 2 and the funnel portion 3.

In FIG. 3A, curves III1A, III2A, III3A, III4A and III5A show cross-sections of the outer wall contours of the yoke-mounting portion AR taken at lines III1—III1, III2—III2, III3—III3, III4—III4 and III5—III5 of FIG. 2, respectively, and in FIG. 3B, curves III1B, III2B, III3B, III4B and III5B show cross-sections of the inner wall contours of the yoke-mounting portion AR taken at lines III1—III1, III2—III2, III3—III3, III4—III4 and III5—III5 of FIG. 2, respectively.

As shown in FIG. 3A, in the color cathode ray tube in accordance with an embodiment of the present invention, the cross-sections of the outer wall contours of the yoke-mounting portion AR are curved convexly away from the tube axis in the approximately entire region of the yoke-mounting portion AR.

In this embodiment, as shown in FIG. 3B, cross-sections of the inner wall contours of the yoke-mounting portion AR taken at lines beyond line III3—III3 toward the panel portion 1 are curved convexly toward the tube axis (that is, pincushion-shaped). But the present invention is not limited to this configuration, and cross-sections of the inner wall contours of the yoke-mounting portion AR taken at lines beyond line III3—III3 toward the neck portion 2 can be curved convexly toward the tube axis (that is, pincushion-shaped).

Figure 4:
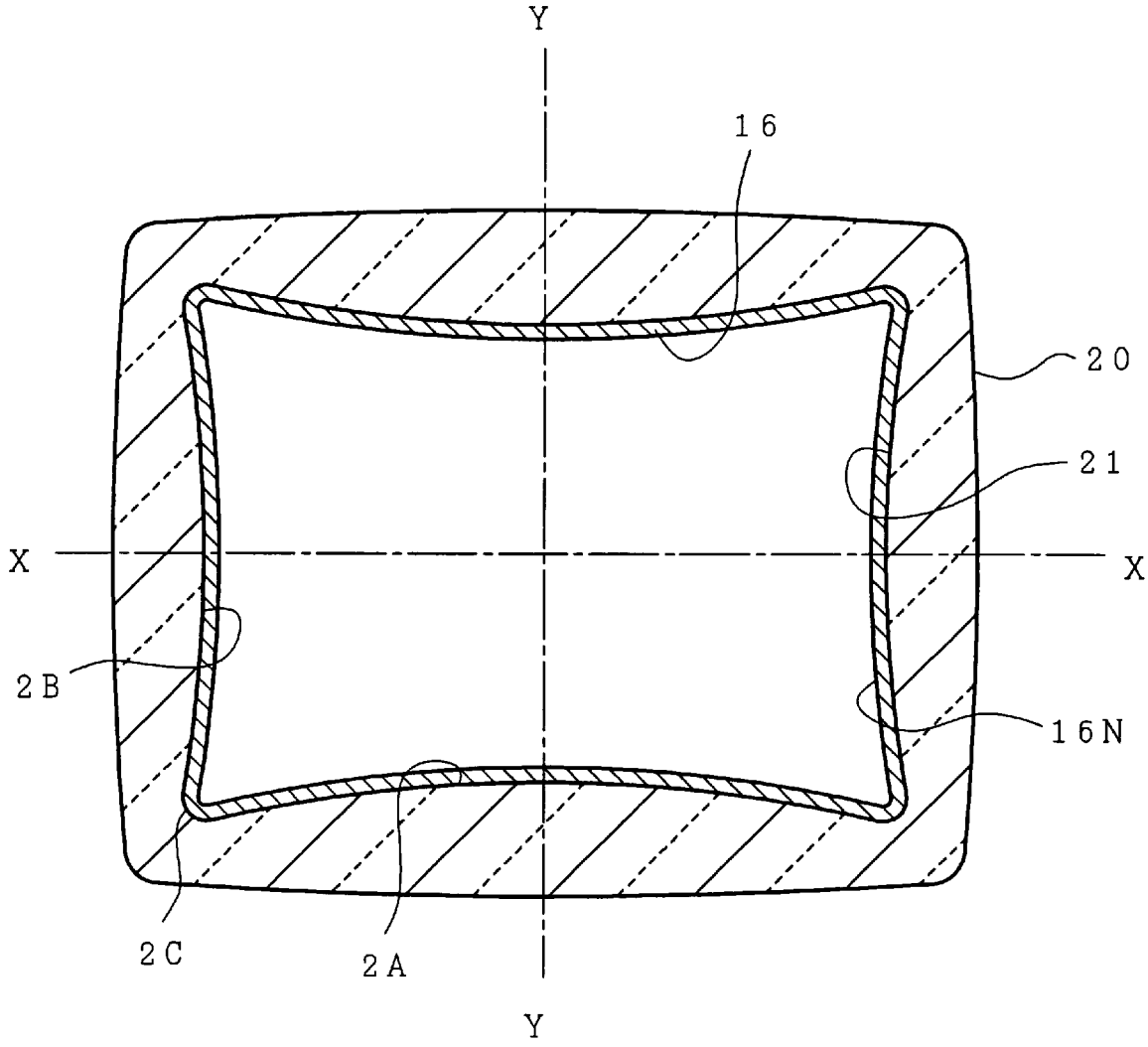
FIG. 4 is a transverse cross-sectional view of the yoke-mounting portion taken along line III3—III3 of FIG. 2.

FIG. 4 is a cross-sectional view of the yoke-mounting portion taken along line III3—III3 of FIG. 2. In FIG. 4, reference numerals 20 and 21 denote cross-sections of the outer and inner wall contours of the yoke-mounting portion AR taken at line III3—III3 of FIG. 2, respectively.

Both the outer and inner wall contours of the yoke-mounting portion AR taken at line III3—III3 of FIG. 2 are approximately rectangular, the outer wall contour of the yoke-mounting portion is curved slightly convexly away from the tube axis (that is, barrel-shaped), and the inner wall contour 21 of the yoke-mounting portion is curved slightly convexly toward the tube axis (that is, pincushion-shaped) with four rounded corners 2C. X-X and Y-Y indicate the major and minor axes, respectively.

Returning to FIG. 2, a first end 16N1 of the first part 16N of the internal conductive film 16 and a first end 16F1 of the second part 16F of the internal conductive film 16 overlap with an overlap of about 5 mm to about 15 mm in the yoke-mounting portion AR. A second end 16N2 of the first part 16N is positioned in the neck portion 2 such that a forward end of the electron gun 9 of FIG. 1 facing toward the phosphor elements 4 is surrounded by the first part 16N.

A second end 16F2 of the second part 16F is positioned in the vicinity of the seal line 14 of the panel portion 1 and the funnel portion 3.

The internal conductive film 16 was fabricated as follows. First a first solution containing graphite particles, metallic oxides, water glass and others dispersed in a solvent is prepared. Next the solution is coated on the rotating funnel portion 3 by brushing (hereinafter referred to as a rotary coating method) such that the first part 16N of the internal conductive film 16 is formed to extend from its second end 16N2 positioned in the neck portion 2 to its first end 16N1 positioned in the yoke-mounting portion AR.

In this coating operation, it is necessary to position the first end 16N1 of the first part 16N of the internal conductive film 16 at a distance in a range of 60 mm to 150 mm measured from the splice line 21 between the neck portion 2 and the funnel portion 3.

In the fabrication of the first part 16N of the internal conductive film 16, the uniform thickness of the internal conductive film 16 is obtained in the neck portion 2 by the rotary coating method because the neck portion 2 is cylindrical, but it is difficult to obtain the uniform thickness of the internal conductive film 16 in the four corners 2C except for the long sides 2A and the short sides 2B in the yoke-mounting portion AR shown in FIG. 4 because the yoke-mounting portion AR is of the generally truncated quadrilateral-pyramidal shape. Therefore it is preferable to add another operation of coating the four corners 2C by moving a brush backward and forward approximately in parallel with the tube axis by using the first solution.

Next, another solution having a composition different from that of the first solution is coated on the funnel portion 3 by the rotary coating method such that the second part 16F of the internal conductive film 16 is formed to extend from its first end 16F1 to its second end 16F2 positioned in the funnel portion 3. The first end 16F1 is overlapped on the first end 16N1 of the first part 16N in the funnel portion 3.

In this embodiment, there is difference in composition between the two materials for forming the first part 16N and the second part 16F of the internal conductive film 16, respectively, and it is preferable that the first part 16N contains metal particles in addition to graphite particles and has resistivity equal to or less than a few tenths of 1 Ω• cm, the second part 16F has a resistivity equal to or less than a few hundredths of 1 Ω• cm, and that is, the resitivity of the first part 16N is greater than that of the second part 16F.

Figure 5A:
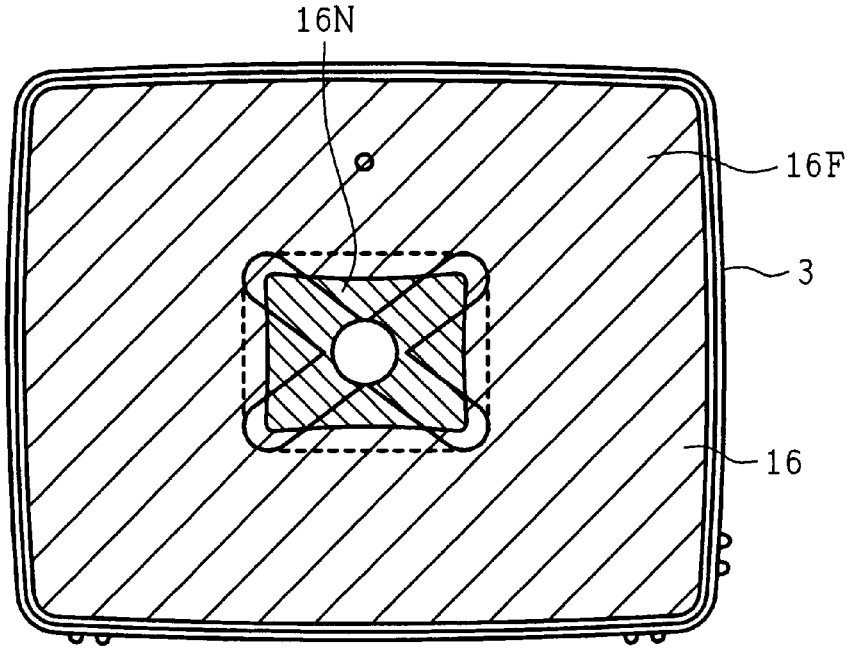
FIGS. 5A and 5B are schematic front and side views of a funnel portion of a color cathode ray tube in accordance with another embodiment of the present invention before the funnel portion is joined to a panel portion by frit sealing, respectively.
Figure 5B:
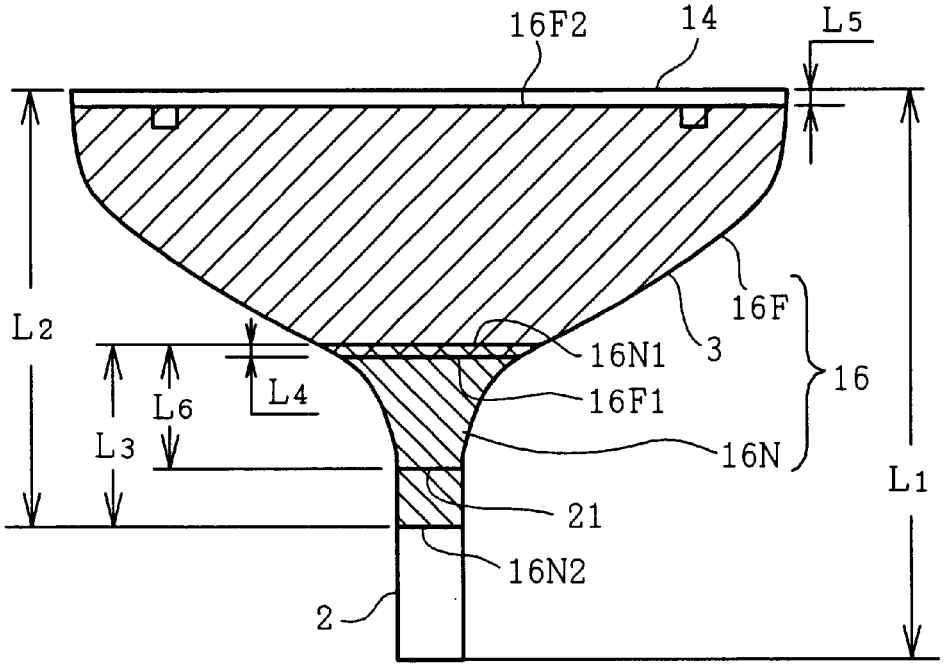

Now specific embodiments will be explained. FIGS. 5A and 5B are a schematic external front view seen from its panel-portion side and a schematic external side view of a funnel portion of a specific embodiment of a color cathode ray tube in accordance with the present invention before the funnel portion is joined to a panel portion by frit sealing, respectively.

The notation in FIG. 5B is employed as follows:

$L_1$=the sum of lengths of the neck portion 2 and the funnel portion 3, $L_2$=an axial distance from one end 16N2 of the internal conductive film 16 positioned in the neck portion 2 to the seal line 14 of the funnel portion 3, $L_3$=an axial length of the first part 16N of the internal conductive film 16, $L_4$=an axial length of the overlap of the first part 16N and the second part 16F of the internal conductive film 16, $L_5$=an axial distance from the other end 16F2 of the internal conductive film 16 positioned in the funnel portion 3 to the seal line 14, and $L_6$=an axial distance from the splice line 21 to the first end 16N1 of the first part 16.

Table 1 shows dimensional examples of color cathode ray tubes of 46 cm in diagonal screen size for 90° and 100° deflection angles in accordance with the present invention.

TABLE 1

| Deflection angles | L1 (mm) | L2 (mm) | L3 (mm) | L4 (mm) | L5 (mm) | L6 (mm) |
|---|---|---|---|---|---|---|
| 90° | 315.5 | 245 | 114 | 8 | 10 | 60 |
| 100° | 273.6 | 205 | 94 | 10 | 8 | 60 |

The desired position of the first end 16N1 depends upon the maximum deflection angle of a cathode ray tubes, but it achieves the object of the present invention if the first end 16N1 is positioned at a distance in a range of 60 mm to 150 mm from the splice line 21 between the neck portion 2 and the funnel portion 3.

In fabrication of a 46 cm-diagonal screen, 90°-deflection angle color cathode ray tube in accordance with the dimensions of Table 1, a first solution containing graphite, titanium dioxide and potassium silicate was used to form the first part 16N of the internal conductive film 16, and a second solution containing graphite and potassium silicate was used to form the second part 16F of the internal conductive film 16. The completed color cathode ray tube could limit a spark current to a value equal to or less than 50A, that is, equal to or less than one-half the spark current with the prior art cathode ray tube.

As a coating solution for the first part 16N of the internal conductive film 16, it is preferable that the solution contains solids comprising graphite particles forming 15% to 25% by weight of the solids, titanium dioxide forming 15% to 25% by weight of the solids, and potassium silicate forming 45% to 70% by weight of the solids, the percentages by weight of the graphite particles, titanium dioxide and the potassium silicate adding to 100%.

As a coating solution for the second part 16F of the internal conductive film 16, it is preferable that the solution contains solids comprising graphite particles forming 60% to 70% by weight of the solids and potassium silicate forming 35% to 45% by weight of the solids, the percentages by weight of the graphite particles and the potassium silicate adding to 100%.

Figure 6A:
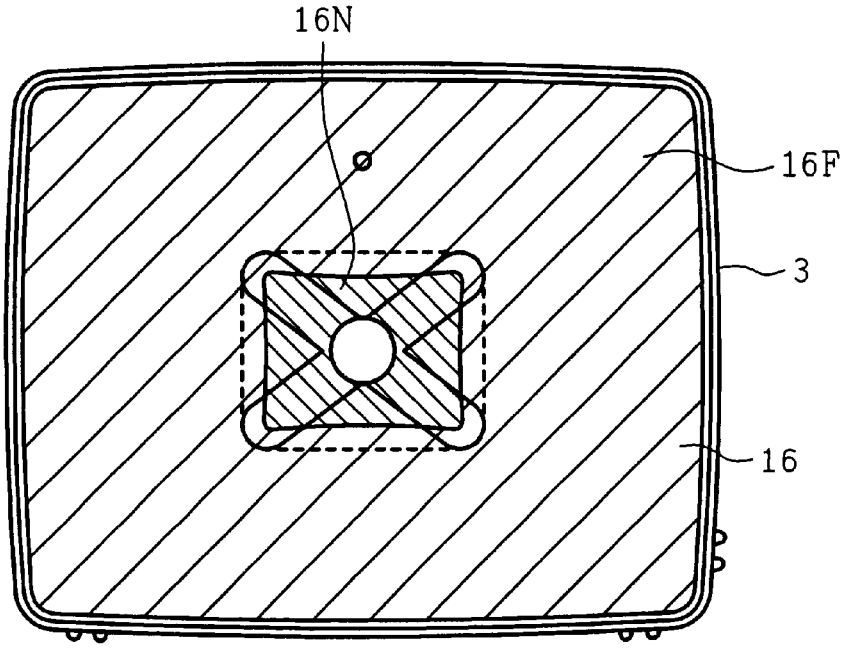
FIGS. 6A and 6B are schematic front and side views of a funnel portion of a modification of FIGS. 5A and 5B.
Figure 6B:
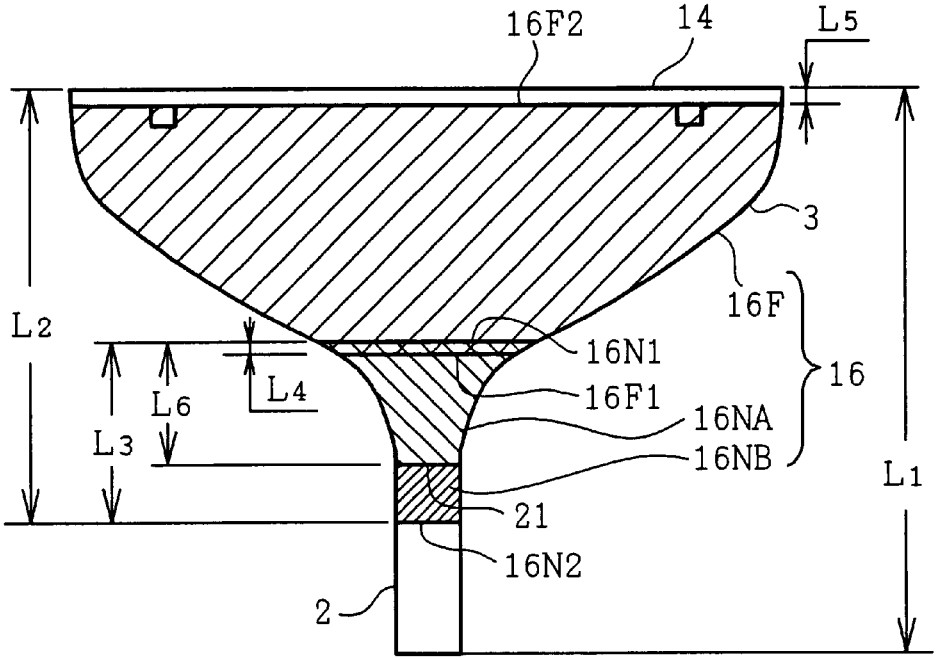

FIGS. 6A and 6B are a schematic external front view seen from its panel-portion side and a schematic external side view of a funnel portion of a modification of the color cathode ray tube of FIGS. 5A and 5B. In this modification, the entire construction is identical in structure with the cathode ray tube explained in connection with FIGS. 5A and 5B, except that the first part 16N is subdivided into the first subpart 16NA and the second subpart 16NB which are formed of material compositions different from each other. The first subpart 16NA extends from the splice line 21 to the first end 16N1 and the second subpart 16NB extends a little beyond the splice line 21 from the second end 16N2 to overlap with the first subpart 16NA.

As a coating solution for the first subpart 16NA of the internal conductive film 16, it is preferable that the solution contains solids comprising graphite particles forming 15% to 25% by weight of the solids, titanium dioxide forming 45% to 70% by weight of the solids, and potassium silicate forming 35% to 60% by weight of the solids, the percentages by weight of the graphite particles, titanium dioxide and the potassium silicate adding to 100%.

As a coating solution for the second subpart 16NB of the internal conductive film 16, it is preferable that the solution contains solids comprising graphite particles forming 15% to 25% by weight of the solids, titanium dioxide forming 15% to 25% by weight of the solids, and potassium silicate forming 45% to 70% by weight of the solids, the percentages by weight of the graphite particles, titanium dioxide and the potassium silicate adding to 100%.

As a coating solution for the second part 16F of the internal conductive film 16, it is preferable that the solution contains solids comprising graphite particles forming 60% to 70% by weight of the solids and potassium silicate forming 35% to 45% by weight of the solids, the percentages by weight of the graphite particles and the potassium silicate adding to 100%.

In the operation of coating the yoke-mounting portion of truncated quadrilateral-pyramidal shape, the graphite solution flows in the grooves formed at the four corners of the quadrilateral-pyramidal shape and consequently, coating characteristics are degraded compared with the case of the conventional yoke-mounting portion of truncated cone shape.

In this modification, the quadrilateral-pyramidal portion is coated with the graphite solution having higher viscosity to improve the coating characteristics. Coating of the graphite solution is facilitated by decreasing the proportion of graphite, increasing the proportion of titanium dioxide and potassium silicate, and thereby increasing the viscosity of the solution.

The second part 16F can also be subdivided into plural portions differing in resistivity. An additional highly scratch-resistant conductive film can be superposed on a portion of the internal conductive film 16 in contact the bulb spacers 20 shown in FIG. 1 by using a solution different in composition, viscosity and evolution of gas from the resultant internal conductive film.

With this configuration of the present invention, a highly reliable cathode ray tube is obtained by facilitating the operation of coating of the internal conductive film uniformly on the inner wall of the cathode ray tube, and consequently, preventing non-uniformity in thickness of the internal conductive film caused by non-uniform coating of the solution and by formation of pools of the solution at corners of the quadrilateral-pyramidal shape, or flowing down of the graphite solution into the neck portion. The fact that the increasing proportions of titanium oxide and potassium silicate and the decreasing proportion of graphite increase viscosity of the solution is taken advantage of to facilitate the coating of the graphite and to increase adherence of the graphite film in the present invention. organic compositions such as carboxymethyl cellulose or gelatin are present in an amount of between about 10% and about 20% by weight of the solution in the solution.

It is needless to say that the present invention provides an advantage of improving the deflection efficiency greatly by employing the yoke-mounting portion of the generally truncated quadrilateral-pyramidal shape compared with a cathode ray tube employing the yoke-mounting portion having a circular cross-section.

The embodiments in accordance with the present invention facilitate and assure the operation of coating the internal conductive film as well as reduce the deflection power consumption by the deflection yoke.

The coating solution for the internal conductive film is coated over the entire area of the inner wall of the yoke-mounting portion of the funnel portion without concentration of the coating solution at the corners of the generally truncated quadrilateral-pyramidal shape of the yoke-mounting portion before the coating solution dries, and consequently, this eliminates peeling off of the graphite film due to non-uniformity in film thickness and unwanted flowing-down into the neck portion of the wet graphite solution concentrated at the corners of the generally truncated quadrilateral-pyramidal shape.

The present invention is not limited to a cathode ray tube or a color cathode ray tube of the above-mentioned shape illustrated in the above embodiments, but is also applicable to a so-called "flat tube" having a flat panel portion, for example.

As explained above, the present invention provides a highly reliable cathode ray tube having improved breakdown voltage characteristics obtained by coating the internal conductive film over the entire area of the inner wall of the funnel portion without the concentration of the wet coating solution at the corners of the inner wall of the yoke-mounting portion in the operation of coating the internal conductive film and thereby eliminating the peeling-off of the graphite film due to non-uniformity in film thickness and the flowing down into the neck portion of a portion of the wet graphite solution concentrated at the corners of the inner wall, and reducing the spark current.

What is claimed is:

1. A color cathode ray tube comprising:

an evacuated envelope comprising a generally rectangular panel portion, a narrow neck portion having a circular cross-section and a funnel portion tapering down from a panel-portion side thereof toward a neck-portion side thereof for connecting said panel portion and said neck portion, said funnel portion being provided with a yoke-mounting portion of generally truncated quadrilateral-pyramidal shape for mounting a beam deflection yoke therearound on said neck-portion side of said funnel portion;

a three-color phosphor screen formed on an inner surface of said panel portion;

an electron gun housed in said neck portion; and an internal conductive film extending from an inner wall of said neck portion to an inner wall of said funnel portion, said internal conductive film comprising a first part and a second part, said first part being formed of graphite, metallic oxide and potassium silicate, said second part being formed of graphite and potassium silicate, wherein said first part extends from said neck portion in the vicinity of a forward end of said electron gun to a position in said yoke-mounting portion spaced a distance in a range of 60 mm to 150 mm from a splice line between said neck portion and said funnel portion, and said second part overlaps with said first part at opposing ends thereof and extends to a vicinity of a seal line between said funnel portion and said panel portion, and wherein said first part is comprised principally of
15 to 25 weight % graphite,
15 to 25 weight % titanium oxide and
45 to 70 weight % potassium silicate, and said second part is comprised principally of
60 to 70 weight % graphite and
35 to 45 weight % potassium silicate.

2. The color cathode ray tube according to claim 1, wherein, in the first part, amounts of said graphite, said titanium oxide and said potassium silicate add up to 100%; and in said second part, amounts of said graphite and said potassium silicate add up to 100%.

3. The color cathode ray tube according to claim 1, wherein said first part and said second part differ from each other in resistivity.

4. The color cathode ray tube according to claim 3, wherein the resistivity of the first part is greater than that of the second part.

5. A color cathode ray tube comprising:

an evacuated envelope comprising a generally rectangular panel portion, a narrow neck portion having a circular cross-section and a funnel portion tapering down from a panel-portion side thereof toward a neck-portion side thereof for connecting said panel portion and said neck portion;

said funnel portion being provided with a yoke-mounting portion of generally truncated quadrilateral-pyramidal shape for mounting a beam deflection yoke therearound on said neck-portion side of said funnel portion;

a three-color phosphor screen formed on an inner surface of said panel portion;

an electron gun housed in said neck portion; and an internal conductive film extending from an inner wall of said neck portion to an inner wall of said funnel portion, said internal conductive film comprising a first part and a second part, said first part being formed of graphite, metallic oxide and potassium silicate, said second part being formed of graphite and potassium silicate, wherein said first part extends from said neck portion in the vicinity of a forward end of said electron gun to a position in said yoke-mounting portion spaced a distance in a range of 60 mm to 150 mm from a splice line between said neck portion and said funnel portion, and said second part overlaps with said first part at opposing ends thereof and extends to a vicinity of a seal line between said funnel portion and said panel portion, and wherein said first part is divided into a first subpart disposed on a panel-portion side of said first part and a second subpart disposed on a neck-portion side of said first part, a boundary between said first and second subparts being in the vicinity of said splice line, said first subpart is comprised principally of
15 to 25 weight % graphite,
45 to 70 weight % titanium oxide and
35 to 60 weight % potassium silicate, said second subpart is comprised principally of
15 to 25 weight % graphite,
15 to 25 weight % titanium oxide and
45 to 70 weight % potassium silicate, and said second part is comprised principally of
60 to 70 weight % graphite and
35 to 45 weight % potassium silicate.

6. The color cathode ray tube according to claim 5, wherein, in said first subpart, amounts of said graphite, said titanium oxide and said potassium silicate add up to 100%; in said second subpart, amount of said graphite, said titanium oxide and said potassium silicate add up to 100%; and in said second part, amount of said graphite and said potassium silicate add up to 100%.

* * * * *